US010040110B2

(12) United States Patent
Ishizuka et al.

(10) Patent No.: US 10,040,110 B2
(45) Date of Patent: Aug. 7, 2018

(54) FORMING SYSTEM AND FORMING METHOD

(71) Applicant: SUMITOMO HEAVY INDUSTRIES, LTD., Tokyo (JP)

(72) Inventors: Masayuki Ishizuka, Ehime (JP); Norieda Ueno, Kanagawa (JP); Masayuki Saika, Ehime (JP); Takashi Komatsu, Tochigi (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/382,327

(22) Filed: Dec. 16, 2016

(65) Prior Publication Data

US 2017/0095853 A1 Apr. 6, 2017

Related U.S. Application Data

(63) Continuation of application No. PCT/JP2015/066772, filed on Jun. 10, 2015.

(30) Foreign Application Priority Data

Jun. 18, 2014 (JP) ..... 2014-125436

(51) Int. Cl.
*B21D 26/041* (2011.01)
*B21D 26/033* (2011.01)

(52) U.S. Cl.
CPC ..... *B21D 26/033* (2013.01); *B21D 26/041* (2013.01)

(58) Field of Classification Search
CPC .. B21D 26/033; B21D 26/035; B21D 26/039; B21D 26/041; B21D 26/043; B21D 26/045; B21D 26/047; B21D 26/02
See application file for complete search history.

(56) References Cited

U.S. PATENT DOCUMENTS 2,861,530 A * 11/1958 Macha ..... B21D 26/041 192/85.12
4,761,982 A 8/1988 Snyder
(Continued)

FOREIGN PATENT DOCUMENTS

JP 57-115989 A * 7/1982 ..... B21D 26/02
JP 58-107225 A * 6/1983 ..... B21D 26/02
(Continued)

OTHER PUBLICATIONS

International Search Report issued in Application No. PCT/JP2015/066772, dated Sep. 1, 2015.
(Continued)

*Primary Examiner* — Edward Tolan
(74) *Attorney, Agent, or Firm* — Michael Best & Friedrich LLP

(57) ABSTRACT

A forming system that forms a metal pipe by expansion in a die includes a heater that heats at least an end part of a metal pipe material, a fluid supply unit that supplies a fluid into the metal pipe material to expand the metal pipe material, and a controller that controls the heater and the fluid supply unit, the fluid supply unit has a nozzle that supplies the fluid from the end part of the metal pipe material into the metal pipe material, and the controller controls the heater so as to heat the end part of the metal pipe material at least before the supply of the fluid by the fluid supply unit, and controls the fluid supply unit so as to expand the end part of the metal pipe material.

16 Claims, 6 Drawing Sheets

(56) References Cited

U.S. PATENT DOCUMENTS

| | | | | |
|---|---|---|---|---|
| 4,827,605 | A * | 5/1989 | Krips | B21D 39/06 29/523 |
| 5,992,197 | A * | 11/1999 | Freeman | B21D 26/033 29/421.1 |
| 6,067,831 | A * | 5/2000 | Amborn | B21D 26/033 29/421.1 |
| 6,261,392 | B1 | 7/2001 | Sundgren et al. | |
| 7,269,986 | B2 * | 9/2007 | Pfaffmann | B21D 26/033 72/342.94 |
| 7,464,572 | B2 * | 12/2008 | Miyanaga | B21D 26/033 29/421.1 |
| 8,408,034 | B2 * | 4/2013 | Ishihara | B21D 26/047 29/421.1 |
| 9,498,814 | B2 * | 11/2016 | Sikora | B21D 26/045 |
| 2004/0040636 | A1 | 3/2004 | Watanabe et al. | |
| 2004/0065394 | A1 * | 4/2004 | Ryu | B21D 26/045 148/695 |
| 2008/0307848 | A1 * | 12/2008 | Hori | B21C 37/155 72/58 |
| 2016/0101456 | A1 | 4/2016 | Sikora et al. | |

FOREIGN PATENT DOCUMENTS

| | | | |
|---|---|---|---|
| JP | 2002-503290 | A | 1/2002 |
| JP | 2003-154415 | A | 5/2003 |
| JP | 2004-337898 | A | 12/2004 |
| JP | 2012-000654 | A | 1/2012 |
| KR | 10-2004-0087765 | A | 10/2004 |
| WO | WO 2014/187852 | A1 | 11/2014 |

OTHER PUBLICATIONS

Office Action issued in Canadian Patent Application No. 2,952,548, dated Dec. 18, 2017.

Office Action issued in Canadian Patent Application No. 2,952,548, dated Mar. 5, 2018.

* cited by examiner

FORMING SYSTEM AND FORMING METHOD

RELATED APPLICATIONS

Priority is claimed to Japanese Patent Application No. 2014-125436, filed Jun. 18, 2014, the entire content of which is incorporated herein by reference.

BACKGROUND

Technical Field

Certain embodiments of the present invention relate to a forming system and a forming method adapted to form a metal pipe.

Description of Related Art

Forming systems that perform forming by expansion with the supply of a fluid into a metal pipe material have been known. For example, a forming system disclosed in the related art is provided with a pair of upper and lower dies, a holding unit that holds a metal pipe material between the upper die and the lower die, and a fluid supply unit that supplies a fluid into the metal pipe material held in the holding unit. In this forming device, the metal pipe material is expanded by supplying a fluid into the metal pipe material held between the upper die and the lower die, and thus can be formed into a shape corresponding to a shape of the die. Such a forming method is referred to as hydroforming.

SUMMARY

According to an embodiment of the present invention, there is provided a forming system that forms a metal pipe by expansion in a die, including a heater that heats at least an end part of a metal pipe material, a fluid supply unit that supplies a fluid into the metal pipe material to expand the metal pipe material, and a controller that controls the heater and the fluid supply unit, in which the fluid supply unit has a nozzle that supplies the fluid from the end part of the metal pipe material into the metal pipe material, and the controller controls the heater so as to heat the end part of the metal pipe material at least before the supply of the fluid by the fluid supply unit, and controls the fluid supply unit so as to expand the end part of the metal pipe material by a pressing force generated by pressing the nozzle against the end part of the metal pipe material, or an expansion force generated by supplying the fluid from the nozzle to the end part of the metal pipe material.

According to an embodiment of the present invention, there is provided a forming method for forming a metal pipe by expansion in a die, including a heating step for heating at least an end part of a metal pipe material, an expansion step for expanding the end part of the metal pipe material, a fluid supply step for supplying a fluid into the metal pipe material to expand the metal pipe material, and a forming step for forming the metal pipe by bringing the expanded metal pipe material into contact with the die, in which the heating step is performed at least before the expansion step and the fluid supply step, and in the expansion step, the end part of the metal pipe material is expanded by a pressing force generated by pressing a nozzle that supplies the fluid from the end part of the metal pipe material into the metal pipe material against the end part, or an expansion force generated by supplying the fluid from the nozzle to the end part of the metal pipe material.

BRIEF DESCRIPTION OF THE DRAWINGS

FIG. 3A is a diagram showing a state in which a metal pipe material is set and held in the die. FIG. 3B is a diagram showing a state in which nozzles are pressed against end parts of the metal pipe material. FIG. 3C is a diagram showing a state in which blow forming has been performed.

DETAILED DESCRIPTION

Figure 1:
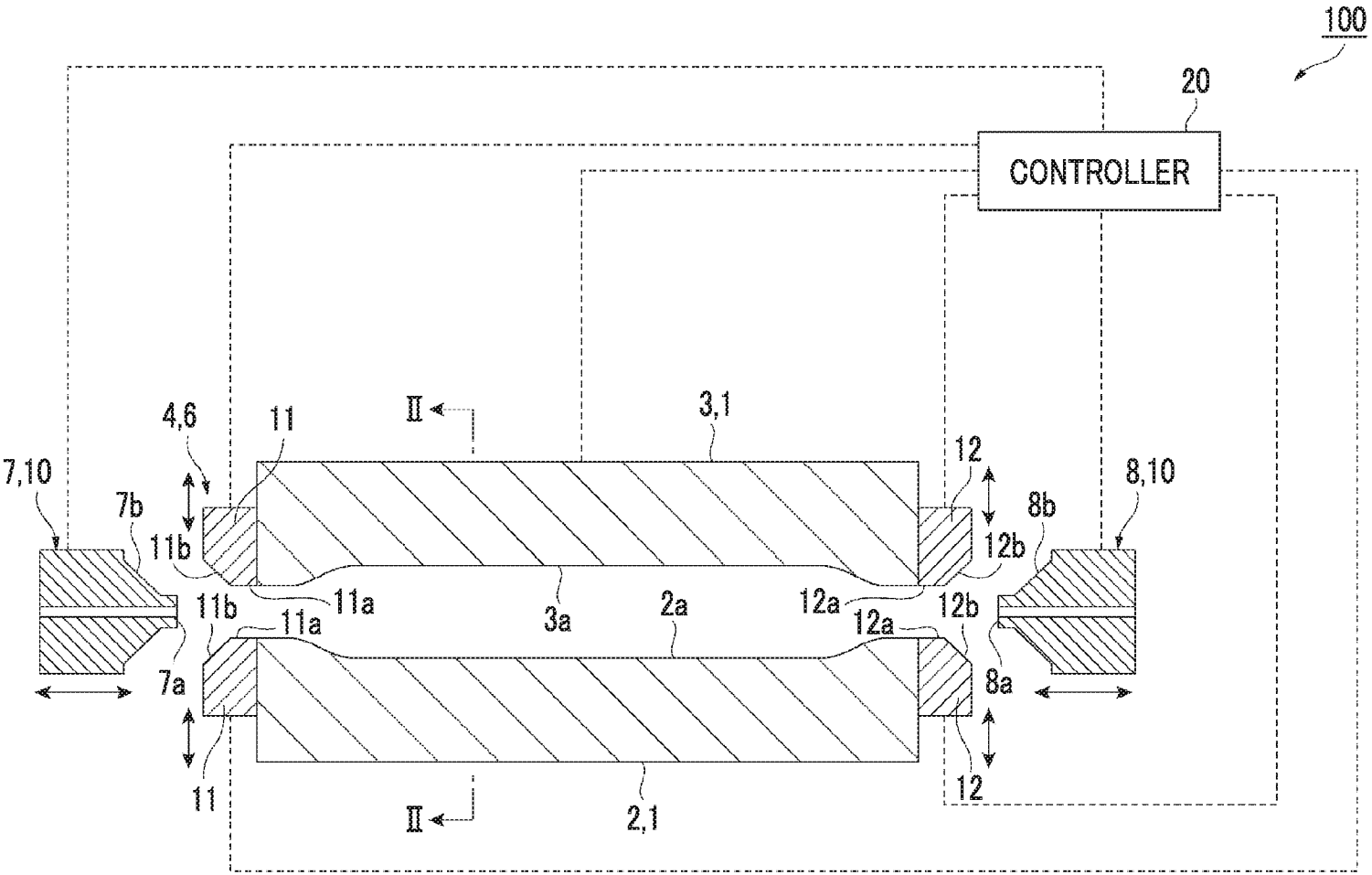
FIG. 1 is a schematic diagram of a configuration of a forming system according to an embodiment of the invention.

Here, in the above-described forming system, a nozzle of the fluid supply unit is inserted into an end part of the metal pipe material held by the holding unit to supply a fluid into the metal pipe material. In this case, the end part of the metal pipe material is pressed against the holding unit by the nozzle, and thus the end part of the metal pipe material is expanded. Accordingly, sealing properties are secured between the nozzle and the holding unit. However, in the above-described forming system, the end part of the metal pipe material may not be expanded well depending on the pressing of the nozzle, and sufficient sealing properties may thus not be secured.

It is desirable to provide a forming system and a forming method capable of improving sealing properties when a fluid is supplied to a metal pipe material.

In the forming system according to an aspect of the invention, the controller controls the heater so as to heat the end part of the metal pipe material at least before the supply of the fluid by the fluid supply unit. Therefore, at least before the supply of the fluid by the fluid supply unit, the end part of the metal pipe material is likely to be deformed by being heated by the heater. In such a state, the end part of the metal pipe material can be easily expanded by a pressing force generated by pressing the nozzle against the end part of the metal pipe material, or an expansion force generated by supplying the fluid from the nozzle to the end part of the metal pipe material. Accordingly, the nozzle can secure sufficient airtightness via an expanded part of the metal pipe material 1. From the above description, according to an aspect of the invention, sealing properties when the fluid is supplied to the metal pipe material can be improved.

The forming system according to the invention may further include a holding unit that holds the end part of the metal pipe material, and the controller may control the fluid supply unit so as to expand the end part of the metal pipe material by a pressing force generated by pressing the end part of the metal pipe material against the holding unit by the nozzle. According to this configuration, sealing between the nozzle and the holding unit via the expanded part of the metal pipe material is possible.

In the forming system according to an aspect of the invention, the controller may control the fluid supply unit so as to expand the end part of the metal pipe material by an expansion force generated by supplying the fluid from the nozzle to the end part of the metal pipe material, and the nozzle may have a receiving unit that surrounds the end part of the metal pipe material from an outer peripheral side at the time of supplying the fluid and receives the expanded end part of the metal pipe material. According to this configuration, the receiving unit of the nozzle receives the expanded part of the metal pipe material, and thus sealing can be performed by the receiving unit and the expanded part.

According to the forming method according to an aspect of the invention, it is possible to obtain the same action and effect as those of the above-described forming system.

Configuration of Forming System

As shown in FIGS. 1 to 3C, a forming system 100 that forms a metal pipe is provided with a blow forming die (die) 1 that includes an upper die 3 and a lower die 2, a holding unit 4 that horizontally holds a metal pipe material 14 between the upper die 3 and the lower die 2, a heater 6 that heats the metal pipe material 14, a fluid supply unit 10 that supplies a fluid into the metal pipe material 14 to expand the metal pipe material, and a controller 20 that controls operations of the blow forming die 1, the holding unit 4, the heater 6, and the fluid supply unit 10. In the following description, a pipe after forming is called a metal pipe 80 (see FIG. 2B), and a pipe during the course of the process for completion is called a metal pipe material 14.

The lower die 2 is composed of a large steel block and is provided with a recessed part 2*a* in an upper surface thereof. The lower die 2 may be fixed to a base or the like (not shown). The upper die 3 is composed of a large steel block and is provided with a recessed part 3*a* in a lower surface thereof. An upper end part of the upper die 3 may be fixed to a slide or the like that is driven by a driving unit (not shown).

Figure 2A:
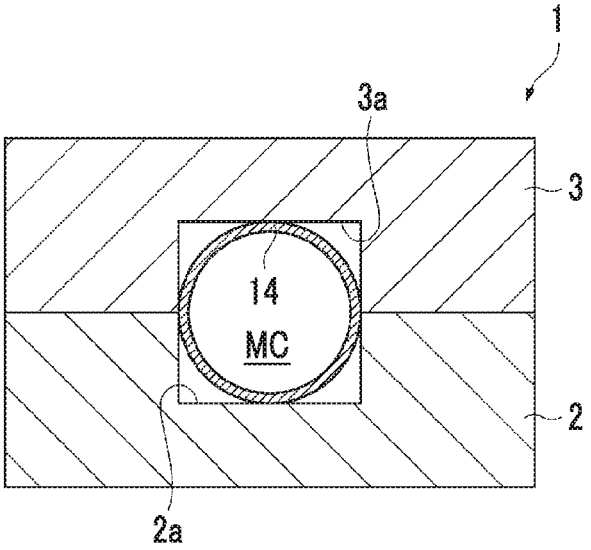
FIGS. 2A and 2B are schematic cross-sectional views of a blow forming die, taken along line II-II shown in FIG. 1.
Figure 2B:
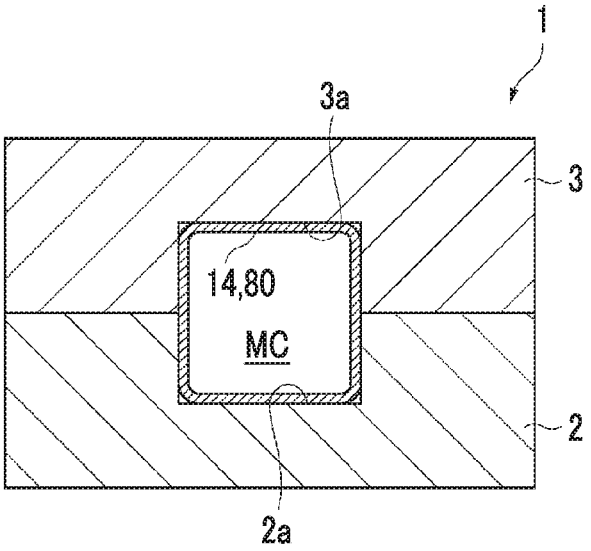

Each of FIGS. 2A and 2B is a schematic cross-sectional view when the blow forming die 1 is viewed from a side. Each is a cross-sectional view of the blow forming die 1 taken along line II-II of FIG. 1 and shows a state of a die position at the time of blow forming. As shown in FIGS. 2A and 2B, the rectangular recessed part 2*a* is formed in the upper surface of the lower die 2. The rectangular recessed part 3*a* is formed at a position opposed to the recessed part 2*a* of the lower die 2 in the lower surface of the upper die 3. In a state in which the blow forming die 1 is closed, a main cavity part MC that is a space having a rectangular cross-sectional shape is formed by combining the recessed part 2*a* of the lower die 2 and the recessed part 3*a* of the upper die 3. The metal pipe material 14 disposed inside the main cavity part MC as shown in FIG. 2A is brought into contact with an inner wall surface of the main cavity part MC by being expanded as shown in FIG. 2B, and is formed into a shape of the main cavity part MC (here, rectangular cross-sectional shape).

The holding unit 4 is provided with a first electrode 11 and a second electrode 12, that are provided near right and left ends (right and left ends in FIG. 1) of the lower die 2, and a first electrode 11 and a second electrode 12, that are provided near right and left ends (right and left ends in FIG. 1) of the upper die 3. The first electrode 11 and the second electrode 12 are configured to advance or retreat in a vertical direction by an actuator (not shown). Recessed grooves 11*a* and 12*a* having a semi-arc shape corresponding to an outer peripheral surface on the lower side of the metal pipe material 14 are formed in upper surfaces of the first and second electrodes 11 and 12 on the lower side, and the metal pipe material 14 can be placed to be well fitted in the recessed grooves 11*a* and 12*a*. In addition, in a front surface of the first electrode 11 (a surface of the die in an outward direction), a tapered recessed surface 11*b* is formed such that the vicinity thereof is recessed at an angle into a tapered shape toward the recessed groove 11*a*, and in a front surface of the second electrode 12 (a surface of the die in an outward direction), a tapered recessed surface 12*b* is formed such that the vicinity thereof is recessed at an angle into a tapered shape toward the recessed groove 12*a*. Recessed grooves 11*a* and 12*a* having a semi-arc shape corresponding to an outer peripheral surface on the upper side of the metal pipe material 14 are formed in lower surfaces of the first and second electrodes 11 and 12 on the upper side, and the metal pipe material 14 can be well fitted in the recessed grooves 11*a* and 12*a*. In addition, in a front surface of the first electrode 11 (a surface of the die in an outward direction), a tapered recessed surface 11*b* is formed such that the vicinity thereof is recessed at an angle into a tapered shape toward the recessed groove 11*a*, and in a front surface of the second electrode 12 (a surface of the die in an outward direction), a tapered recessed surface 12*b* is formed such that the vicinity thereof is recessed at an angle into a tapered shape toward the recessed groove 12*a*. That is, in a case where the metal pipe material 14 is sandwiched between the pairs of upper and lower first and second electrodes 11 and 12 in the vertical direction, the metal pipe material 14 can be surrounded by the first and second electrodes 11 and 12 such that the outer periphery thereof firmly adheres well over the whole periphery.

In this embodiment, the first electrode 11 and the second electrode 12 also function as the heater 6 that heats the metal pipe material 14. Specifically, the first and second electrodes 11 and 12 are connected to a power supply (not shown), and the metal pipe material 14 is heated by supply electric power to the metal pipe material 14. The heater 6 can heat at least end parts 14*a* and 14*b* of the metal pipe material 14.

The fluid supply unit 10 is provided with nozzles 7 and 8 that supply a fluid from the end parts 14*a* and 14*b* of the metal pipe material 14 into the metal pipe material. The nozzles 7 and 8 are connected to a cylinder unit via a cylinder rod (not shown) so as to advance or retreat in accordance with an operation of the cylinder unit. The end parts 14*a* and 14*b* of the metal pipe material 14 are inserted into tip end parts of the nozzles 7 and 8, respectively, and a fluid is supplied into the metal pipe material 14. Accordingly, the metal pipe material 14 disposed inside the blow forming die 1 can be expanded. As the fluid that is supplied from the nozzles 7 and 8, a fluid such as water or oil can be employed. The nozzles 7 and 8 are provided with tapered conical surfaces 7*b* and 8*b* tapered toward the tip end parts 7*a* and 8*a*, respectively. The detailed description of the structures of the nozzles 7 and 8 will be given in combination with the description of the operation by the controller 20 to be described later.

Action of Forming System

Figures 3A, 3B, 3C:
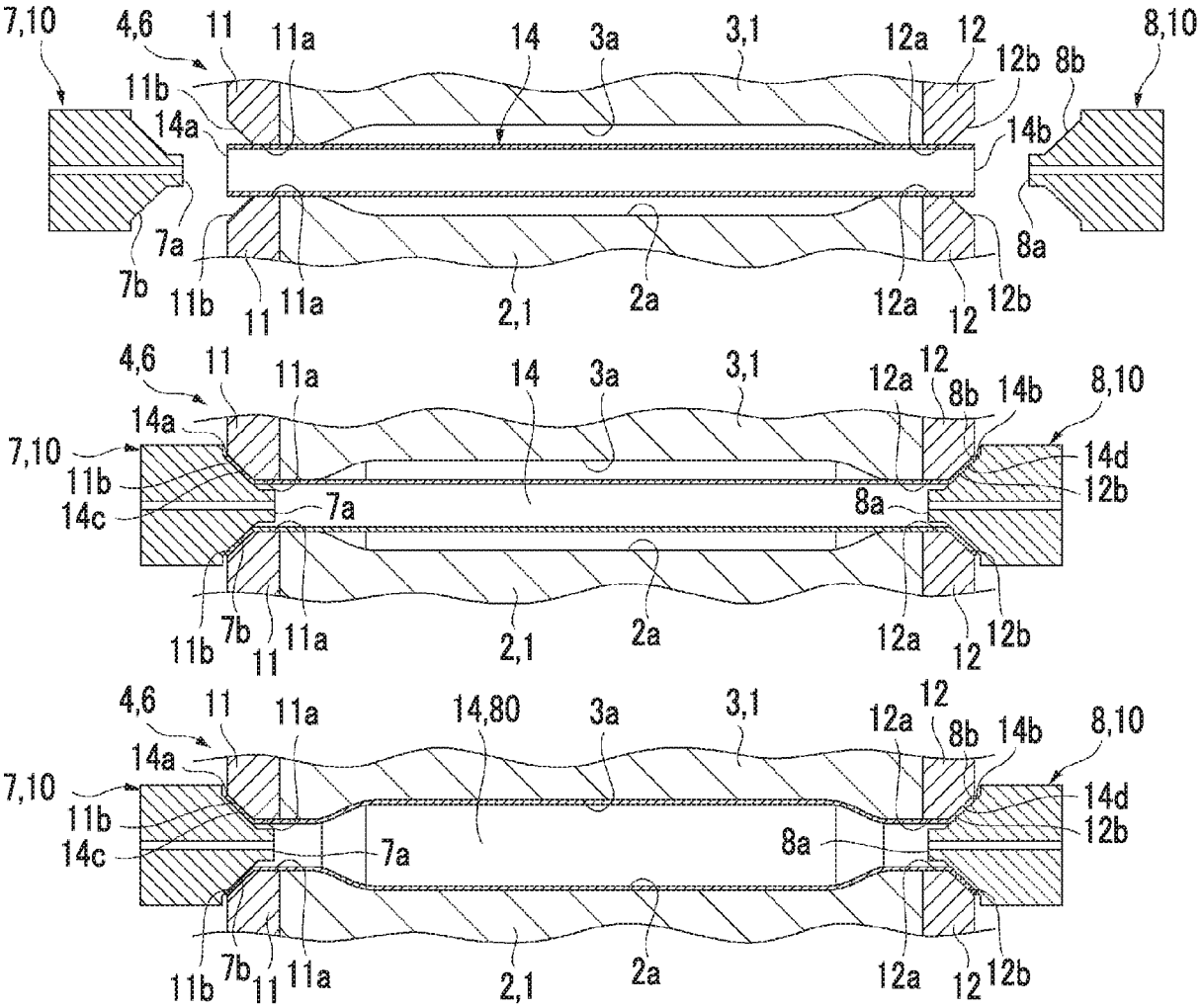
FIGS. 3A to 3C are diagrams showing a manufacturing process that is performed by the forming system.

Next, the action of the forming system 100 will be described. FIGS. 3A to 3C show steps from a pipe injection step for injecting the metal pipe material 14 as a material to a step for forming a metal pipe 80 by subjecting the metal pipe material to expansion and forming. As shown in FIG. 3A, the metal pipe material 14 is prepared, and a robot arm (not shown) or the like places the metal pipe material 14 on the first and second electrodes 11 and 12 provided in the lower die 2. Since the first and second electrodes 11 and 12 have the recessed grooves 11*a* and 12*a*, respectively, the metal pipe material 14 is positioned by the recessed grooves 11*a* and 12*a*. Next, the controller 20 (see FIG. 1) controls the holding unit 4 to hold the metal pipe material 14 by the holding unit 4. Specifically, as in FIG. 3A, an actuator that allows the first and second electrodes 11 and 12 to advance or retreat is operated such that the first and second electrodes 11 and 12 positioned on the upper and lower sides, respectively, are brought closer to and into contact with each other. Due to this contact, both of the end parts of the metal pipe material 14 are sandwiched between the first and second electrodes 11 and 12 from the upper and lower sides. In addition, due to the presence of the recessed grooves 11*a* and 12*a* formed in the first and second electrodes 11 and 12, the metal pipe material 14 is sandwiched so as to firmly adhere over the whole periphery thereof. However, the invention is not limited to the configuration in which the metal pipe material 14 firmly adheres over the whole periphery thereof, and may have a configuration in which the first and second electrodes 11 and 12 are brought into contact with a part of the metal pipe material 14 in a peripheral direction. In addition, in a state in which the first and second electrodes 11 and 12 hold the metal pipe material 14, a part of the metal pipe material 14 at each of the end parts 14*a* and 14*b* protrudes outward from at least an end part on the outer side of each of the recessed grooves 11*a* and 12*a*. That is, the metal pipe material 14 is held by the holding unit 4 in a state in which a gap is formed between a part of the metal pipe material 14 at each of the end parts 14*a* and 14*b* and each of the tapered recessed surfaces 11*b* and 12*b*.

Next, the controller 20 controls the heater 6 to heat the metal pipe material 14 (heating step). Specifically, the controller 20 turns on a switch of the heater 6. After that, electric power is supplied from a power supply (not shown) to the metal pipe material 14 via the first and second electrodes 11 and 12, and the metal pipe material 14 produces heat (Joule heat) due to the resistance present in the metal pipe material 14. Accordingly, the heater 6 can heat at least the end parts 14*a* and 14*b* of the metal pipe material 14 (in this embodiment, the entire metal pipe material 14). The heating step using the heater 6 is performed at least before the supply of a fluid by the fluid supply unit 10. Next, the blow forming die 1 is closed with respect to the metal pipe material 14 after heating to dispose and seal the metal pipe material 14 in the cavity of the blow forming die 1.

Then, as shown in FIG. 3B, the controller 20 controls the nozzles 7 and 8 of the fluid supply unit 10 such that the end parts 14*a* and 14*b* of the metal pipe material 14 are expanded by a pressing force generated by pressing the nozzles 7 and 8 of the fluid supply unit 10 against the end parts 14*a* and 14*b* of the metal pipe material 14, respectively (expansion step). In addition, the controller 20 controls the fluid supply unit 10 such that the end parts 14*a* and 14*b* of the metal pipe material 14 are expanded by a pressing force generated by pressing the end parts 14*a* and 14*b* of the metal pipe material 14 against the holding unit 4 by the nozzles.

Figure 4:
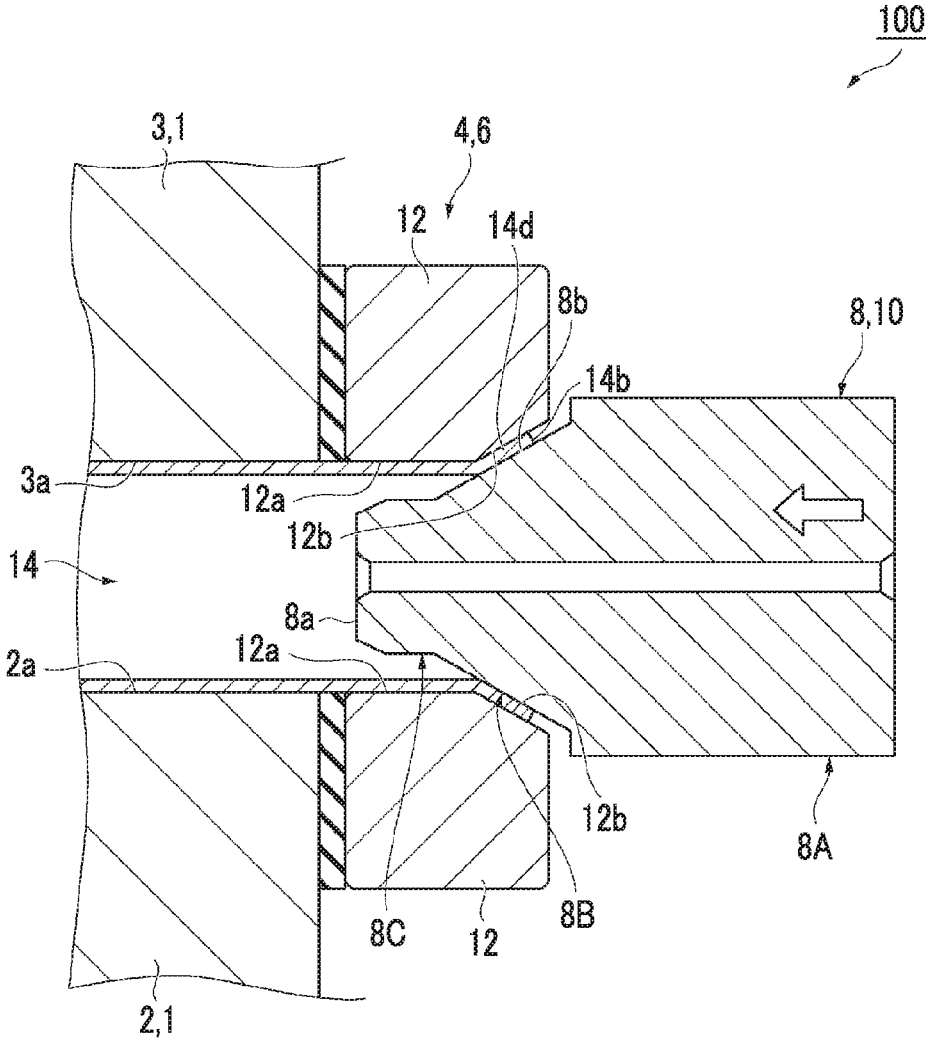
FIG. 4 is an enlarged view of the vicinity of the nozzle.

Here, the configuration of the nozzle 8 will be described in detail with reference to FIG. 4. Since the nozzle 7 has a configuration similar to that of the nozzle 8, the description thereof will be omitted. FIGS. 1 and 3A to 3C are schematic diagrams of the configuration of the forming system 100, and FIG. 4 is a diagram showing the configuration of the nozzle 8 in greater detail. Therefore, there are parts having a partially different shape. In the following description, central axes of the metal pipe material 14 and the nozzle 8 are coincident with each other. As shown in FIG. 4, the nozzle 8 is provided with a large diameter part 8A that is formed on the base end side (on the outer side of the blow forming die 1), a tapered part 8B that is tapered from the large diameter part 8A toward the tip end side (on the side of the blow forming die 1), and a small diameter part 8C that extends from the tapered part 8B to the tip end side. The diameter of the small diameter part 8C is set to be smaller than an inner diameter of the metal pipe material 14 before blow forming or expansion and an inner diameter of the recessed groove 12*a*. The diameter of the large diameter part 8A is set to be larger than an inner diameter of an end part (a part having the largest inner diameter) on the outer side of the tapered recessed surface 12*b*. The tapered surface 8*b* of the tapered part 8B is inclined so as to be substantially parallel to the tapered recessed surface 12*b* of the second electrode 12.

By virtue of such a configuration, in a case where the nozzle 8 is inserted such that the small diameter part 8C of the nozzle 8 is inserted into the metal pipe material from the end part 14*b* of the metal pipe material 14 before expansion (in a state of FIG. 3A), the end part 14*b* is brought into contact with the tapered surface 8*b* of the nozzle 8. In this case, since the end part 14*b* of the metal pipe material 14 is heated by the heater 6, and is thus likely to be deformed. Accordingly, in a case where the nozzle 8 is further moved, a part of the metal pipe material 14 at the end part 14*b* is deformed such that the diameter thereof expands along the shape of the tapered surface 8*b*. The expanded part 14*d* of the metal pipe material 14 expanded by the pressing of the tapered surface 8*b* is pressed against the tapered recessed surface 12*b* of the second electrode 12 by the tapered surface 8*b* of the nozzle 8. That is, the tapered surface 8*b* of the nozzle 8 is pressed against the tapered recessed surface 12*b* of the second electrode 12 via the expanded part 14*d* of the metal pipe material 14. Accordingly, sealing properties are secured between the tapered surface 8*b* of the nozzle 8 and the tapered recessed surface 12*b* of the second electrode 12.

As shown in FIG. 3B, the end parts 14*a* and 14*b* on both sides of the metal pipe material 14 are sealed by the nozzles 7 and 8. After completion of the sealing, the controller 20 controls the fluid supply unit 10 to allow a high-pressure fluid to flow into the metal pipe material 14 (fluid supply step). Accordingly, the expanded metal pipe material 14 is brought into contact with the blow forming die 1 and is deformed along the shape of the blow forming die 1, and thus a metal pipe 80 is formed (forming step).

The metal pipe material 14 is easily expanded and formed by being softened by heating of the heater 6.

Next, the action and effect of the forming system 100 according to this embodiment will be described.

Here, as a forming system according to a comparative example, a configuration will be described in which a tapered recessed surface 11*b* of a first electrode 11 and a tapered surface 7*b* of a nozzle 7 are brought into direct contact with each other, and a tapered recessed surface 12*b* of a second electrode 12 and a tapered surface 8*b* of a nozzle 8 are brought into direct contact with each other to secure sealing properties. In this case, when a metal pipe material 14 is held by a holding unit 4, end parts 14*a* and 14*b* do not protrude outward from the first and second electrodes 11 and 12, respectively. In the forming system according to the comparative example, since the first and second electrodes 11 and 12 and the nozzles 7 and 8 are respectively brought into direct contact with each other, both of them are required to have durability in order to secure sufficient sealing properties. That is, in a case where abrasion or the like is generated in at least one of the tapered recessed surface 11*b* and the tapered surface 7*b*; and the tapered recessed surface 12*b* and the tapered surface 8*b*, sufficient sealing properties may not be secured.

As a forming system according to another comparative example, a configuration will be described in which similarly to the forming system 100 according to this embodiment, a metal pipe material 14 is expanded by a pressing force generated by pressing end parts 14*a* and 14*b* of the metal pipe material 14 against a holding unit 4 by nozzles 7 and 8, respectively, but no heater 6 is provided. In the forming system according to the comparative example, the end parts 14*a* and 14*b* of the metal pipe material 14 are not expanded well by the pressing of the nozzles 7 and 8, and sufficient sealing properties may not be secured.

Regarding this, in the forming system 100 according to this embodiment, the controller 20 controls the heater 6 so as to heat the end parts 14*a* and 14*b* of the metal pipe material 14 at least before the supply of a fluid by the fluid supply unit 10. Therefore, at least before the supply of a fluid by the fluid supply unit 10, the end parts 14*a* and 14*b* of the metal pipe material 14 are likely to be deformed by being heated by the heater 6. In such a state, the end parts 14*a* and 14*b* of the metal pipe material 14 can be easily expanded by a pressing force generated by pressing the nozzles 7 and 8 against the end parts 14*a* and 14*b* of the metal pipe material 14, respectively. Accordingly, the nozzles 7 and 8 can secure sufficient airtightness via the expanded parts 14*c* and 14*d* of the metal pipe material 14, respectively. From the above description, according to the forming system 100 according to this embodiment, sealing properties when the fluid is supplied to the metal pipe material 14 can be improved.

In addition, the forming system 100 according to this embodiment is further provided with a holding unit 4 that holds the metal pipe material 14 at the end parts 14*a* and 14*b*. The controller 20 controls the fluid supply unit 10 such that the end parts 14*a* and 14*b* of the metal pipe material 14 are expanded by a pressing force generated by pressing the end parts 14*a* and 14*b* of the metal pipe material 14 against the holding unit 4 by the nozzles 7 and 8, respectively. According to this configuration, sealing between the nozzle 7 and the holding unit 4 via the expanded part 14*c* of the metal pipe material 14 is possible, and sealing between the nozzle 8 and the holding unit 4 via the expanded part 14*d* of the metal pipe material 14 is possible. In a case where sealing properties are secured using such a configuration, by firmly adhering and pressing the metal pipe material 14 softened by being heated between the tapered recessed surfaces 11*b* and 12*b* and the tapered surfaces 7*b* and 8*b*, sufficient sealing properties can be secured regardless of circumstances such as abrasion of the tapered recessed surface 11*b* and the tapered surface 7*b* and abrasion of the tapered recessed surface 12*b* and the tapered surface 8*b*. In addition, sufficient sealing properties can be secured in a state in which the nozzles 7 and 8 have a simple shape. In addition, the nozzles 7 and 8 after blow forming can be easily removed.

Figure 5:
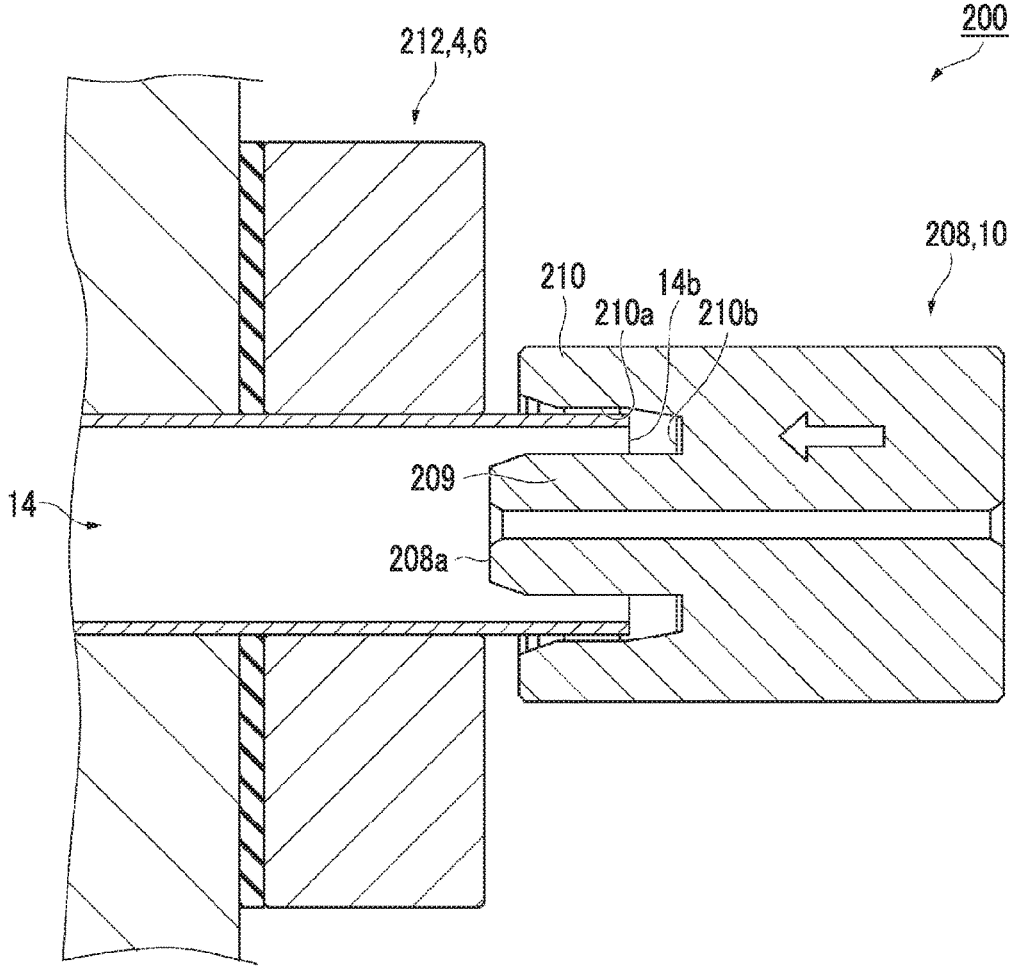
FIG. 5 is an enlarged view of a nozzle according to a modified example.
Figure 6A:
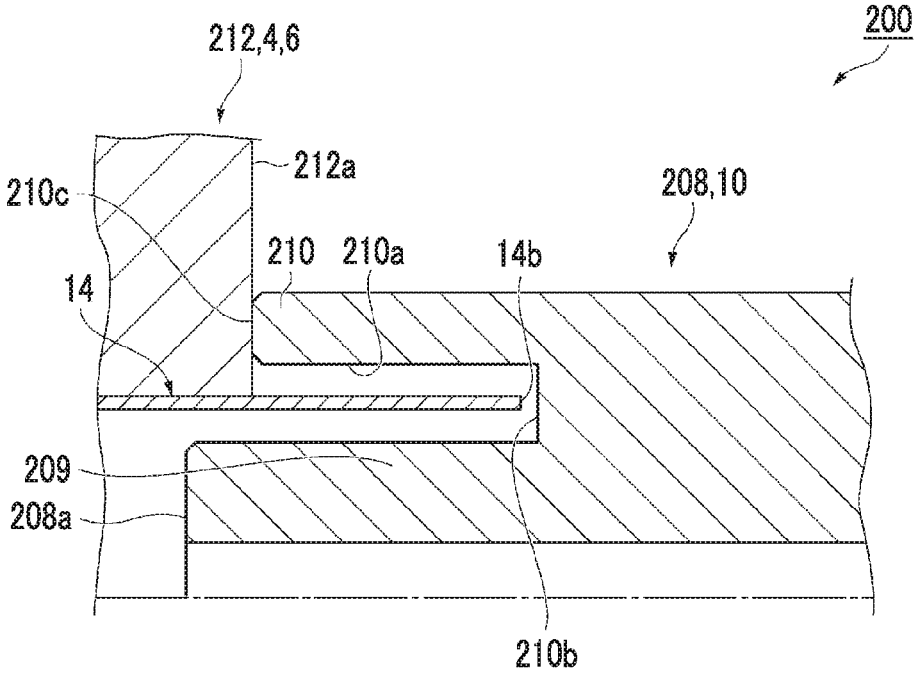
FIGS. 6A and 6B are diagrams showing an operation of the nozzle according to the modified example.
Figure 6B:
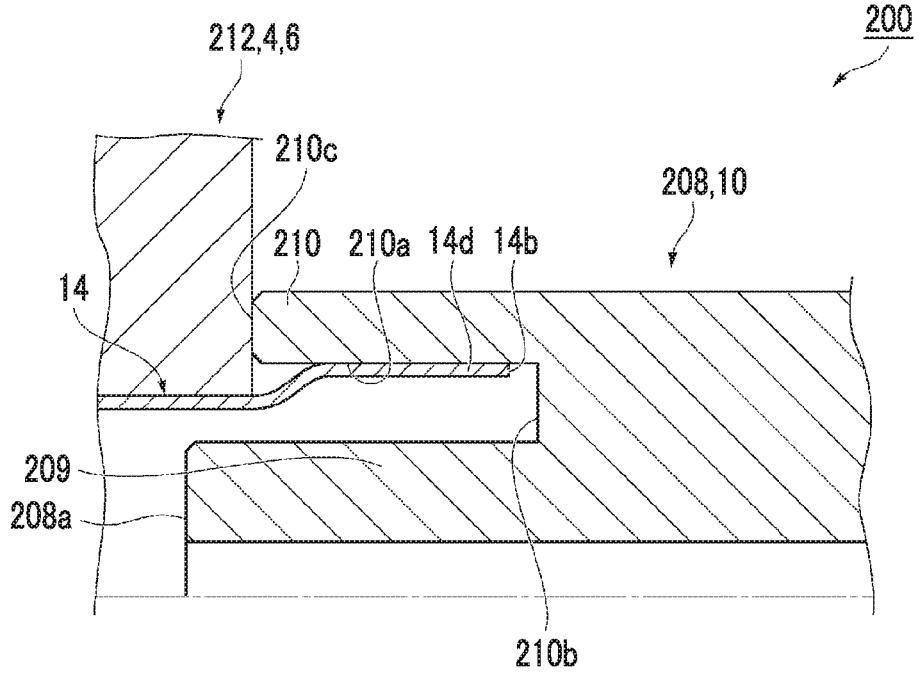

For example, a forming system 200 shown in FIGS. 5 to 6B may be employed. In this forming system 200, a controller (not shown) controls a heater 6 so as to heat end parts 14*a* and 14*b* of a metal pipe material 14 at least before the supply of a fluid by a fluid supply unit 10, and controls the fluid supply unit 10 so as to expand the end part 14*b* of the metal pipe material 14 by an expansion force generated by supplying the fluid from a nozzle 208 to the end part 14*b* of the metal pipe material 14. In the forming system 200 according to the modified example, the nozzle 208 has a receiving unit 210 that surrounds the end part 14*b* of the metal pipe material 14 from the outer peripheral side at the time of supplying the fluid and receives the expanded end part 14*b* of the metal pipe material 14. The receiving unit 210 is formed so as to be separated from an outer peripheral surface of the small diameter part 209 that is inserted into the metal pipe material 14, and so as to surround the small diameter part 209. The controller controls the fluid supply unit 10 such that the end part 14*b* of the metal pipe material 14 is expanded by an expansion force generated by supplying the fluid from the nozzle 208 to the end part 14*b* of the metal pipe material 14. Therefore, the receiving unit 210 receives the expanded end part 14*b* of the metal pipe material 14, and thus sealing properties are secured. In this configuration, the expansion step and the fluid supply step are simultaneously performed.

As shown in FIG. 6A, the small diameter part 209 of the nozzle 208 is inserted into the metal pipe material 14 when the fluid is supplied. In this case, the nozzle 208 is inserted up to a position where a tip end surface 210*c* of the receiving unit 210 is brought into contact with an end surface 212*a* of an electrode 212. In this case, the end part 14*b* of the metal pipe material 14 is separated from a bottom surface 210*b* of the receiving unit 210 so as not to interfere therewith. In this state, a receiving surface 210*a* of the receiving unit 210 is separated from the outer peripheral surface of the metal pipe material 14. Next, as shown in FIG. 6B, in a case where the nozzle 208 supplies a fluid to the metal pipe material 14, a part near the end part 14*b* of the metal pipe material 14 is expanded by an expansion force, and is thus brought into contact with the receiving surface 210*a* of the receiving unit 210. Accordingly, the expanded part 14*d* of the metal pipe material 14 and the receiving surface 210*a* of the receiving unit 210 firmly adhere to each other, and thus sealing properties are secured. According to such a configuration, natural following of the metal pipe material 14 in an axial direction, caused by blow forming, and following control are possible (for example, as in the configuration of FIG. 4, the position of the metal pipe material 14 is not fixed at near the end parts 14*a* and 14*b*). In addition, adhesion properties can be improved by the blowing pressure.

Although preferable embodiments of the invention have been described, the invention is not limited to the above-described embodiments.

In the above-described embodiments, the heater 6 capable of performing a heating treatment between the upper and lower dies is provided to heat the metal pipe material 14 using Joule heat generated by means of electricity, but the invention is not limited thereto. For example, the forming system may be provided with a heating furnace or the like, and a metal pipe after heating in the heating furnace may be carried between the dies. Other than Joule heat generated by means of electricity, radiation heat of the heater may be used, and a high-frequency induced current can also be used to perform the heating. For example, before the die is closed, a heater may be disposed near the metal pipe material 14 and may perform heating. In this case, it is preferable that at least the end parts 14*a* and 14*b* of the metal pipe material 14 be heated.

In the above-described embodiments, as the fluid that is supplied from the nozzles 7 and 8, a fluid such as water or oil has been used, but a gas such as compressed air or an inert gas may be supplied.

It should be understood that the invention is not limited to the above-described embodiment, but may be modified into various forms on the basis of the spirit of the invention. Additionally, the modifications are included in the scope of the invention.

What is claimed is:

1. A forming system that forms a metal pipe by expansion in a die, the system comprising:

a fluid supply unit that has a nozzle, the nozzle is configured to supply a fluid into the metal pipe material to expand the metal pipe material; and a heater configured to heat at least an end part of a metal pipe material, a tapered conical surface of the nozzle is configured to come into contact with the end part of the metal pipe material before the tapered conical surface of the nozzle brings the end part of the metal pipe material into contact with the heater, wherein:

the heater comprises a pair of electrodes that are configured to supply electric power to the metal pipe material to heat the metal pipe material, the tapered conical surface of the nozzle is configured to bring the end part of the metal pipe material into direct physical contact with the electrodes, the pair of electrodes is situated in a vicinity of the die, an end part at each of the electrodes has a tapered recessed surface in a direction away from the die, and recessed grooves into which the metal pipe material is fitted are formed in the pair of electrodes, the end part of the metal pipe material is expandable by pressing the end part of the metal pipe material against the tapered recessed surfaces by the nozzle.

2. The forming system according to claim 1, wherein the tapered conical surface of the nozzle is tapered toward a tip end part of the nozzle.

3. The forming system according to claim 2, wherein the tip end part of the nozzle is configured to extend into the end part of the metal pipe material.

4. The forming system according to claim 1, wherein the tapered conical surface of the nozzle extends toward the tip end part of the nozzle from a perimeter of the nozzle, the perimeter of the nozzle has a diameter that is greater than a diameter of the metal pipe material.

5. The forming system according to claim 1, wherein the tapered conical surface of the nozzle is configured to bring the end part of the metal pipe material into direct contact with the heater.

6. The forming system according to claim 1, wherein the fluid supply unit is controllable to generate a pressing force, the pressing force moves the nozzle so that the tapered conical surface of the nozzle presses the end part of the metal pipe material against the heater.

7. The forming system according to claim 1, wherein the fluid supply unit is controllable to supply the fluid into the metal pipe material.

8. The forming system according to claim 1, wherein the heater is controllable to heat the end part of the metal pipe material before the fluid supply unit supplies the fluid into the metal pipe material.

9. A forming method for forming a metal pipe by expansion in a die wherein a fluid supply unit that has a nozzle, the nozzle is configured to supply a fluid into the metal pipe material to expand the metal pipe material, the method comprising:

bringing a tapered conical surface of the nozzle into contact with an end part of the metal pipe material, the tapered conical surface of the nozzle brings the end part of the metal pipe material into direct physical contact with a pair of electrodes;

bringing the end part of the metal pipe material into contact with a heater after the tapered conical surface of the nozzle has been brought into contact with the end part of the metal pipe material, recessed grooves into which the metal pipe material is fitted are formed in the pair of electrodes;

controlling the heater to heat the end part of the metal pipe material, the heater comprises the pair of electrodes that supply electric power to the metal pipe material to heat the metal pipe material; and expanding the metal pipe material by controlling the fluid supply unit to supply the fluid into the metal pipe material through the nozzle, the end part of the metal pipe material is expanded by pressing the end part of the metal pipe material against the tapered recessed surfaces by the nozzle, wherein the pair of electrodes is situated in a vicinity of the die, an end part at each of the electrodes has a tapered recessed surface in a direction away from the die.

10. The forming method according to claim 9, wherein the tapered conical surface of the nozzle is tapered toward a tip end part of the nozzle.

11. The forming method according to claim 10, wherein the tip end part of the nozzle is configured to extend into the end part of the metal pipe material.

12. The forming method according to claim 9, further comprising:

controlling the fluid supply unit to generate a pressing force, the pressing force moves the nozzle so that the tapered conical surface of the nozzle presses the end part of the metal pipe material against the heater.

13. The forming method according to claim 12, wherein bringing the tapered conical surface of the nozzle into contact with the end part of the metal pipe material includes controlling the fluid supply unit to generate the pressing force.

14. The forming method according to claim 9, wherein the heater is controlled to heat the end part of the metal pipe material before the fluid supply unit supplies the fluid into the metal pipe material.

15. The forming method according to claim 9, wherein the tapered conical surface of the nozzle extends toward the tip end part of the nozzle from a perimeter of the nozzle, the perimeter of the nozzle has a diameter that is greater than a diameter of the metal pipe material.

16. The forming method according to claim 9, wherein the tapered conical surface of the nozzle is configured to bring the end part of the metal pipe material into direct contact with the heater.

* * * * *